US006716504B2

(12) United States Patent
Song

(10) Patent No.: US 6,716,504 B2
(45) Date of Patent: Apr. 6, 2004

(54) DECORATIVE STICKER SHEET

(76) Inventor: Sang G. Song, 8 Galaan-Dong, Delseo-Gu, Daegu (KR)

( * ) Notice: Subject to any disclaimer, the term of this patent is extended or adjusted under 35 U.S.C. 154(b) by 0 days.

(21) Appl. No.: 10/287,011

(22) Filed: Nov. 4, 2002

(65) Prior Publication Data

US 2003/0157287 A1 Aug. 21, 2003

(30) Foreign Application Priority Data

Feb. 16, 2002 (KR) ..... 2002-0004644 U

(51) Int. Cl.[7] ..... G09F 3/10

(52) U.S. Cl. ..... 428/40.1; 428/40.2; 428/40.4; 428/41.3; 428/41.5; 428/41.7; 428/41.8; 428/157; 503/201; 503/225

(58) Field of Search ..... 428/40.1, 40.2, 428/40.4, 41.3, 41.5, 41.7, 41.8, 157; 503/201, 225

(56) References Cited

U.S. PATENT DOCUMENTS

| | | | | | |
|---|---|---|---|---|---|
| 3,031,324 | A | * | 4/1962 | Jankowski | 427/147 |
| 4,028,165 | A | * | 6/1977 | Rosenfeld | 428/207 |
| 4,028,474 | A | * | 6/1977 | Martin | 428/40 |
| 4,033,918 | A | * | 7/1977 | Hauber | 428/449 X |
| 4,038,123 | A | | 7/1977 | Sammis | 156/240 |
| 4,044,181 | A | * | 8/1977 | Edhlund | 428/40 |
| 4,054,697 | A | * | 10/1977 | Reed et al. | 428/400 |
| 4,137,842 | A | | 2/1979 | Miller | 101/128 |
| 4,232,076 | A | * | 11/1980 | Stetson et al. | 428/914 X |
| 4,278,483 | A | * | 7/1981 | Mansolillo | 428/207 X |
| 4,409,280 | A | * | 10/1983 | Wiley et al. | 428/159 |
| 4,517,893 | A | | 5/1985 | Wile et al. | 101/123 |
| 4,599,264 | A | * | 7/1986 | Kauffman et al. | 428/336 X |
| 4,605,592 | A | * | 8/1986 | Paquette et al. | 428/424.4 X |
| 4,626,460 | A | * | 12/1986 | Duncan | 428/354 |
| 4,671,174 | A | | 6/1987 | Tartaglia et al. | 101/115 |
| 4,716,052 | A | * | 12/1987 | Waugh et al. | 427/208.8 X |
| 4,759,968 | A | * | 7/1988 | Janssen | 428/354 |
| 4,844,849 | A | * | 7/1989 | Miller | 264/46.4 |
| 5,021,275 | A | | 6/1991 | Kim | 428/42 |
| 5,169,681 | A | | 12/1992 | Kim | 427/147 |
| 5,952,429 | A | | 9/1999 | Ikeda et al. | 525/326.1 |
| 6,403,528 | B1 | * | 6/2002 | Shackle | 503/201 |
| 6,449,774 | B1 | | 9/2002 | Michael | 2/311 |

FOREIGN PATENT DOCUMENTS

| | | | | |
|---|---|---|---|---|
| DE | 901793.6 | | 5/1992 | |
| ES | 9101833 | | 6/1991 | |
| FR | 2645472 | | 12/1993 | |
| GB | 1299948 | * | 12/1972 | 428/40 |
| GB | 2230492 | | 1/1992 | |
| GR | 2000928 | | 12/1997 | |
| JP | 58-13682 | | 1/1983 | |
| JP | 63-75081 | | 4/1988 | |
| JP | 63-194949 | | 8/1988 | |
| JP | 1-250985 | | 10/1989 | |
| JP | 2-284979 | | 11/1990 | |
| JP | 3-75671 | | 12/1991 | |
| JP | 4-29841 | | 1/1992 | |
| JP | 3019191 | | 10/1995 | |
| JP | 08272295 | | 10/1996 | |
| JP | 10180973 | | 7/1998 | |

(List continued on next page.)

*Primary Examiner*—Nasser Ahmad
(74) *Attorney, Agent, or Firm*—Park & Sutton LLP; John K. Park

(57) ABSTRACT

A decorative sticker sheet comprises a lining paper, an adhesive layer formed on the lining paper, a transparent plastisol layer formed on the adhesive layer, a white plastisol layer formed on the transparent plastisol layer, an ink absorption layer formed on the white plastisol layer, a print layer in which a design is printed on the ink absorption layer, and a protective coating layer formed on the print layer. The sticker sheet may also comprise a glassy particle layer. The print layer may include designs formed by photosensitive ink or temperature-sensitive ink.

25 Claims, 2 Drawing Sheets

FOREIGN PATENT DOCUMENTS

| | | |
|---|---|---|
| KR | 0029752 | 9/1985 |
| KR | 051069 | 4/1992 |
| KR | 056533 | 6/1992 |
| KR | 071676 | 3/1993 |
| KR | 070276 | 7/1993 |
| KR | 134305 | 4/1996 |
| KR | 101193 | 6/1996 |
| KR | 159054 | 8/1998 |
| KR | 2002-0004644 | 2/2002 |

* cited by examiner

DECORATIVE STICKER SHEET

CLAIMING FOREIGN PRIORITY

The applicant claims and requests a foreign priority, through the Paris Convention for the Protection of Industry Property, based on a patent application filed in the Republic of Korea (South Korea) with the filing date of Feb. 16, 2002, with the application number UTILITY-2002-0004644, by the applicant (See the Attached Declaration).

BACKGROUND OF THE INVENTION

The present invention relates to a decorative sticker sheet. More particularly, the invention relates to a decorative sticker sheet that can be used for both oil-based ink printing and aqueous ink printing.

Generally, a sticker sheet is a printed sheet on one side of which is printed a certain pattern, and on the other side of which is applied an adhesive so that it can be stuck to a glass pane of an automobile or a showcase. The sticker sheet is backed by a lining sheet and the sticker can be easily separated from the lining sheet. The sticker sheet is made from soft synthetic resin, and various patterns including characters, geometrical shapes, and letters are printed on the sticker sheet. The sticker sheet is used mainly for advertisement or decoration. Printing of patterns on the sticker sheet is usually performed by offset printing or gravier printing.

A decorative sticker by prior art, which has been widely used, is briefly explained. Adhesive is applied on a lining sheet by silk screen method, and plastisol ink is applied by silk screen method on the adhesive. Then they are heated so that the ink is made into a film of soft plastisol layer. Then a pattern layer is made by applying pigments on the plastisol layer, and the pattern layer is coated with a coating material. The final product is made by silk screening a design on the sticker sheet prepared by the above processes.

Disadvantages of this sticker sheet are that: manufacturing cost is high since the sheet involves several printing processes in addition to making the sticker sheet itself; and since a fixed design should be uniformly printed, it cannot satisfy all of the colors and designs that the users want. If it is required to print various shapes on the sticker sheet, the manufacturing cost becomes higher because a same design is not produced in a mass production scale.

In the past, ceramic tiles were widely used to interior decoration. Since ceramic tiles were difficult to work with, and designs of ceramic tiles were too simple, sticker sheets replaced ceramic tiles. Thus sticker sheets have been used to decorate floors and walls.

Such sticker sheets explained above are made by constructing an adhesive layer on a lining paper, and heat bonding a PVC sheet, on which a design is printed, on the adhesive layer. The sticker sheet is easily separated from the surface on which the sticker sheet is stuck when a long time has passed after sticking the sticker sheet because the strength of the surface of the sheet is different from that of the adhesive layer. Also the wall is contaminated because part of the adhesive layer is not peeled from the surface, when the sticker sheet is separated.

Korean utility model registration number 0134305 by the inventor, which was published as Korean utility model laid-open publication number U1997-059600 on Nov. 10, 1997, discloses a rubber resin decorative sticker sheet that overcomes a disadvantage of a sticker by prior art. The prior art sticker is made by a process in which an adhesive layer is constructed on a lining paper, and a soft PVC sheet layer is constructed from a mixture of PVC and DOP, and then a design is printed on the surface of the PVC layer. However, the printed layer of the sticker also is easily bleached and worn out, and when the sticker is removed and disposed, the sticker becomes a pollutant since it is not decomposed. The sticker by the applicant's utility model solves the wear and pollution problems. The utility model discloses a film layer made from a rubber resin, and a printed layer in which a design is printed. The printed layer is positioned at the center of the film layer, and the surface of the printed layer is embossed. This sticker has shock absorbing and anti-skidding functions. This sticker is also biodegradable. However, the sticker of the utility model has a disadvantage that only screen printing method can be used for the sticker.

To overcome this disadvantage, Korean patent application number 2000-0023075 filed on Apr. 29, 2000, by the inventor, which was published as Korean patent laid-open publication number 2001-0098252 on Nov. 8, 2001, discloses a sticker for computer printers and manufacturing method for the sticker. In the publication, a soft white plastisol layer is formed on a temporary lining paper that is coated with a coating agent by applying white plastisol; a transparent plastisol layer is formed on the white plastisol layer by applying transparent plastisol; adhesive is applied on the transparent plastisol layer; a lining paper that is coated with a coating agent is applied on the adhesive; then they are bonded by pressing with rollers; the temporary lining paper is separated from the white plastisol layer; and a polymer coating material is coated and dried on the white plastisol layer. By this process, a smooth finish of the printed surface is achieved, and a sticker sheet for printing can be easily manufactured. Designs or photograph images according to the customer's interest may be printed on the sticker sheet manufactured by the process, and even if such sticker sheets are manufactured by small amounts, the unit price of products is not increased. However, a disadvantage that color was lost under ultraviolet light, etc. was found. Also, although screen printing or printing by an ink jet printer was possible, it was not possible to use offset printing, and thus it did not apply various printing methods.

SUMMARY OF THE INVENTION

The present invention contrives to solve the problems of the prior art as explained above. Therefore an object of the invention is to provide a decorative sticker sheet that is suitable for mass production at a low cost and by a convenient method.

Another object of the invention is to provide a decorative sticker sheet that is suitable for printing various designs.

Still another object of the invention is to provide a decorative sticker sheet that can be used for remodeling a kitchen or a bathroom where tiles are used.

Still another object of the invention is to provide a decorative sticker sheet that has good color fastness against ultraviolet light.

Still another object of the invention is to provide a decorative sticker sheet that can be made by small numbers at low cost so that samples for advertising may be made at low cost.

Still another object of the invention is to provide a decorative sticker sheet that is biodegradable.

Still another object of the invention is to provide a decorative sticker sheet that has improved coating layers or new layers to provide above functionalities.

To achieve the above-described objects, the invention provides a decorative sticker sheet comprising a lining paper, an adhesive layer formed on the lining paper, a transparent plastisol layer formed on the adhesive layer, a white plastisol layer formed on the transparent plastisol layer, and an ink absorption layer formed on the white plastisol layer. The white plastisol layer and the ink absorption layer may be combined into a single layer.

The lining paper is formed by coating silicon resin on a paper and heat-treating at a temperature range from about 160 degree Celsius to about 180 degree Celsius.

The adhesive layer is formed by silk screening acrylic aqueous adhesive.

The transparent plastisol layer is formed by silk screening transparent plastisol ink and heat treating. The heat treating is done at a temperature range from about 150 degree Celsius to about 180 degree Celsius. The transparent plastisol ink comprises polyvinyl choloride and plasticizer. The ink may further comprise binder and starch.

The white plastisol layer is formed by silk screening white plastisol ink, and heat treating. The white plastisol ink comprises white pigments, polyvinyl choloride and plasticizer. The white plastisol ink may further comprise binder and starch.

The ink absorption layer is formed by coating surface active agent. Alternatively, the ink absorption layer is formed by applying mixture of white plastisol, binder, starch and surface active agent. The decorative sticker sheet having the above-described construction may be sold and used for inkjet printing or making sample sticker sheets of numerous designs by consumers or printing companies.

The decorative sticker sheet may further comprise a print layer in which a design is printed on the ink absorption layer, and a protective coating layer formed on the print layer.

The protective coating layer comprises a UV-resistant coating or a plastisol coating.

The print layer may comprise a photosensitive ink layer. The photosensitive ink layer is formed by applying photosensitive ink, which is made from a mixture of transparent resin and photosensitive pigments. The print layer may also comprise a temperature-sensitive ink layer. The temperature-sensitive ink layer is formed by applying temperature-sensitive ink, which is made from a mixture of transparent resin and temperature-sensitive pigments.

The print layer may also comprise a fragrant agent layer.

The decorative sticker sheet may further comprise a glassy particle layer. The glassy particle layer is formed on the protective coating layer, and the glassy particle layer is formed by applying a mixture of transparent resin and glass particles. Preferably, the size of the glass particles is less than about 200 meshes.

The advantageous effects of the present invention are numerous in that: (1) the sticker sheet may be used for both aqueous ink printing and oil-based ink printing; (2) specifically, the sticker sheet may be used for ink-jet printing as well as offset printing; (3) sticker sheets having various designs can be manufactured at low cost; (4) the sticker sheet is durable and resistant to ultraviolet light; (5) the sticker sheet has luxurious appearance and touch; (6) the sticker sheet can simulate ceramic tiles and can be applied on floors, walls and furniture.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
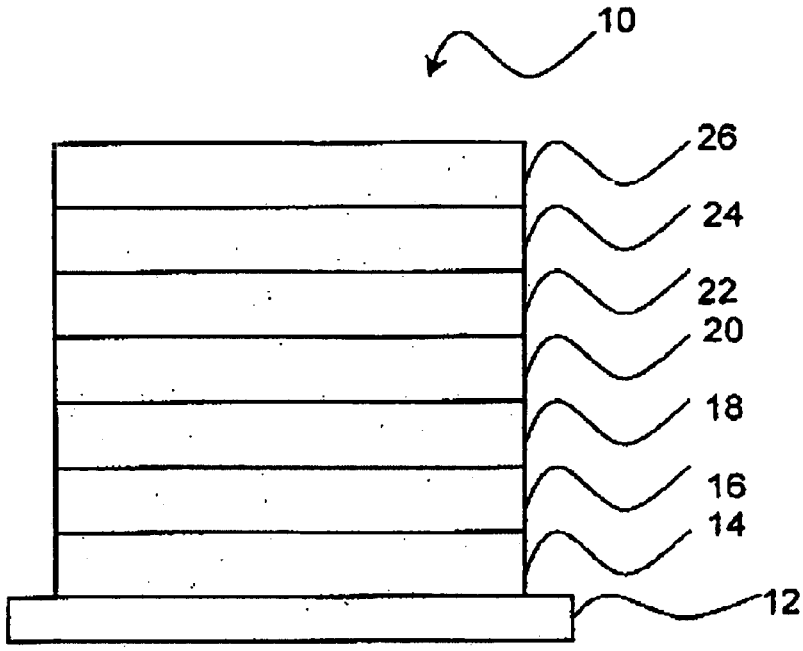
FIG. 1 is a schematic diagram showing the cross-section of the decorative sticker sheet of the invention.

FIG. 1 shows a cross-section of a decorative sticker sheet 10 according to the present invention. The sticker sheet 10 comprises a lining paper 12, an adhesive layer 14 formed on the lining paper 12, a transparent plastisol layer 16 formed on the adhesive layer 14, a white plastisol layer 18 formed on the transparent plastisol layer 16, and an ink absorption layer 20 formed on the white plastisol layer 18.

The lining paper 12 is formed by coating silicon resin on a paper and heat-treating at a temperature range from about 160 degree Celsius to about 180 degree Celsius with an IR heat conveyor. A cast coated paper is used as the paper. KS3755 supplied by Shinetch, Japan is used as the silicon resin.

The adhesive layer 14 is formed by silk screening acrylic aqueous adhesive. Acryl acid ester is used as the adhesive.

The transparent plastisol layer 16 is formed by silk screening transparent plastisol ink and heat treating. The heat treating is done at a temperature range from about 150 degree Celsius to about 180 degree Celsius with an IR heat conveyor. The transparent plastisol ink comprises polyvinyl choloride and plasticizer. ParaDsal or DOP is used as the plasticizer. The transparent plastisol ink may further comprise binder and starch.

The white plastisol layer 18 is formed by silk screening white plastisol ink, and heat treating. The white plastisol ink comprises white pigments, polyvinyl choloride and plasticizer. The white plastisol ink may further comprise binder and starch. The binder is made of acrylic resin. The binder and starch are added by about 15 parts to 100 parts of polyvinyl chloride and plasticizer.

The white plastisol layer 18 over the transparent plastisol layer 16 makes designs printed on the decorative sticker sheet 10 to be seen more vivid.

The ink absorption layer 20 is formed by coating surface active agent. Alternatively, the ink absorption layer 20 is formed by applying mixture of white plastisol, binder, starch and surface active agent. Surface active agent makes it possible that all kinds of printing methods including ink jet printing and offset printing are applicable on the decorative sticker sheet. Printing directly without the ink absorption layer is even difficult for oil-based or offset printing and impossible for aqueous ink printing.

The decorative sticker sheet 10 with the lining paper 12 and layers 14, 16, 18, and 20 may be sold and used for inkjet printing or making sample sticker sheets of numerous designs.

The decorative sticker sheet 10 may further comprise a print layer 22 in which a design is printed on the ink absorption layer 20, and a protective coating layer 24 formed on the print layer 22.

The protective coating layer 24 may comprise a UV-resistant coating or a piastisol coating. UV coating prevents color degradation from various factors including sunlight and ultraviolet light, etc. The protective coating not only protects the print layer 22 but also enhances the appearance and touch of the decorative sticker sheet 10.

The print layer 22 may comprise a photosensitive ink layer. The photosensitive ink layer is formed by applying photosensitive ink, which is made from a mixture of transparent resin and photosensitive pigments. The photosensitive ink changes color when it is exposed at light of specific wavelength such as infrared or ultraviolet rays. For example, the photosensitive ink changes color from transparent to violet when it is exposed to the sunlight.

The print layer 22 may also comprise a temperature-sensitive ink layer. The temperature-sensitive ink layer is formed by applying temperature-sensitive ink, which is made from a mixture of transparent resin and temperature-sensitive pigments. The temperature-sensitive ink changes color at a specified temperature. For example, the temperature-sensitive ink changes color from transparent to blue when the temperature is around 5 degree Celsius. Such ink may be used in a label for beer. The label changes color when the beer reaches the temperature suitable for drinking.

The photosensitive ink and the temperature-sensitive ink may be used to print small area of the printed layer 22 and the remaining area is printed by general printing method.

The print layer 22 may also comprise a fragrant agent layer.

The decorative sticker sheet 10 may further comprise a glassy particle layer 26. The glassy particle layer 26 is formed on the protective coating layer 24. The glassy particle layer 26 is formed by applying a mixture of transparent resin and glass particles. Preferably, the size of the glass particles is less than about 200 meshes. The glassy particle layer 26 further enhances appearance and touch of the decorative sticker sheet 10.

The white plastisol layer 18 and the ink absorption layer 20 may be combined into a single layer. The single layer is formed by silk screening a mixture of white plastisol ink and surface active agent, and heat treating.

The decorative sticker sheet 10 having the lining paper 12 and layers 14, 16, 18, 20, 22, 24 and 26 can be sold and used for decoration and other similar uses.

Figure 2:
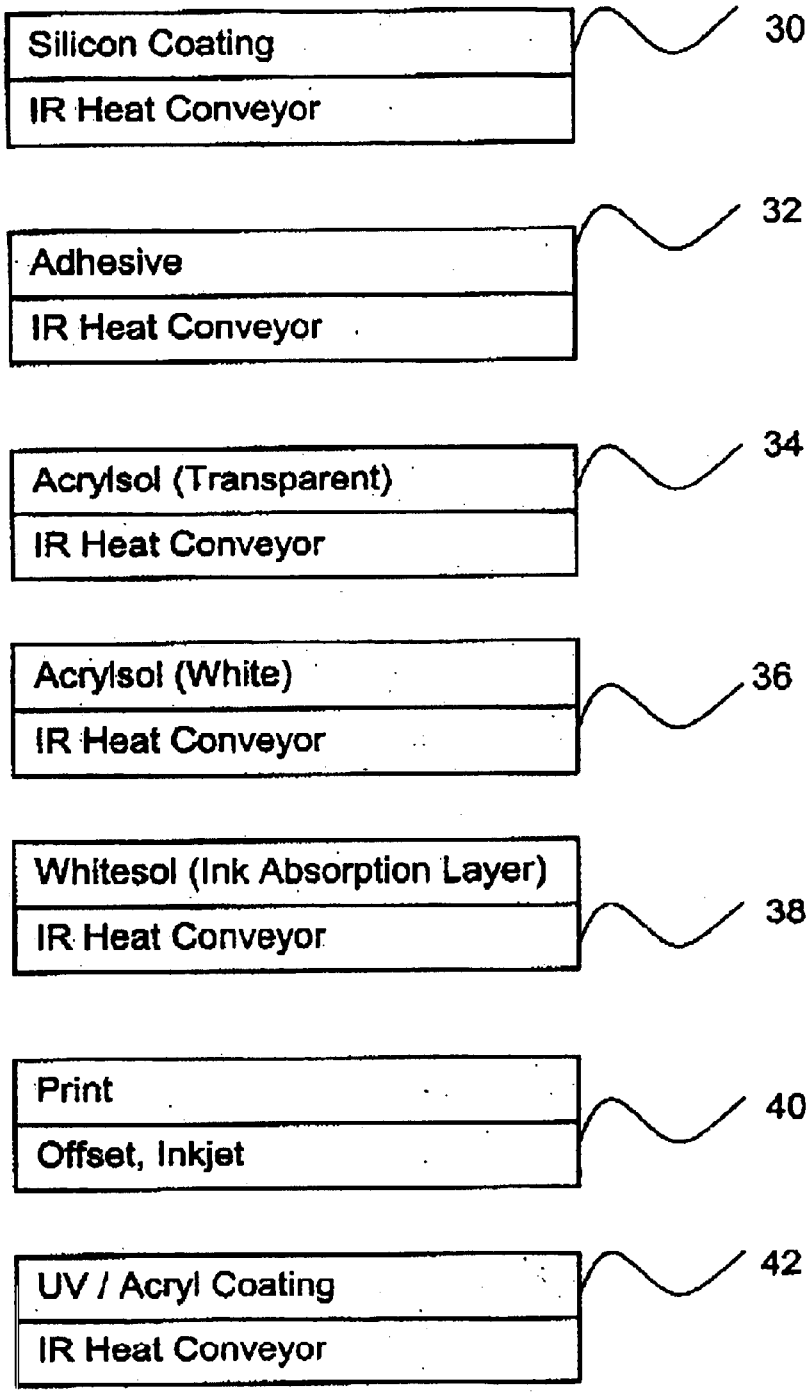
FIG. 2 is a schematic diagram showing procedures to manufacture the decorative sticker sheet of the invention.

FIG. 2 schematically shows procedures to manufacture the decorative sticker sheet 10. In step 30, silicon resin is coated on the lining paper 12 and heated. In step 32, adhesive is applied on the lining paper 12 and heated to form the adhesive layer 14. In step 34, transparent plastisol ink is applied on the adhesive layer 14 and heated to form the transparent plastisol layer 16. In step 36, white plastisol ink is applied on the transparent plastisol layer 16 and heated to form the white plastisol layer 18. In step 38, mixture of white plastisol and surface active agent is applied on the white plastisol layer 18 and heated to form the ink absorption layer 20. In step 40, print layer 22 is formed. Printing can be done by various methods including offset and inkjet printings. The fragrant agent layer, photosensitive ink layer, temperature-sensitive ink layer, and other printed layers are formed in this step. Heat treating or drying by ultraviolet ray is done according to the nature of the printing. In step 42, protective coating is applied on the print layer 22 and heated to form the protective coating layer 24.

With the decorative sticker sheet of the present invention, various designs can be directly printed on the sheet with an ink-jet printer or by offset printing. The designs include letters, figures, characters, and photographs, etc. These designs can be downloaded from the Internet, or captured by a scanner or a digital camera. Thus, the decorative sticker sheet of the present invention maximizes user's choices and convenience. Also small number of sticker sheets per design can be produced at low cost, thus accommodating various uses for the sticker sheet. The glassy particle layer enhances the decorative effect. The UV-resistant protective layer keeps the decorative effect for an extended period when the sheet is used under sunlight or at locations where ultraviolet light is irradiated.

Although the invention has been described in considerable detail, other versions are possible by converting the aforementioned construction. Therefore, the scope of the invention shall not be limited by the specification specified above.

What is claimed is:

1. A decorative sticker sheet comprising:

a) a lining paper;

b) an adhesive layer formed on the lining paper;

c) a transparent plastisol layer formed on the adhesive layer;

d) a white plastisol layer formed on the transparent plastisol layer; and e) an ink absorption layer formed on the white plastisol layer;

wherein the ink absorption layer comprises surface active agent.

2. The decorative sticker sheet of claim 1 wherein the lining paper is formed by coating silicon resin on a paper and heat-treating at a temperature range from about 160 degree Celsius to about 180 degree Celsius.

3. The decorative sticker sheet of claim 1 wherein the adhesive layer is formed by silk screening acrylic aqueous adhesive.

4. The decorative sticker sheet of claim 1 wherein the transparent plastisol layer is formed by silk screening transparent plastisol ink and heat treating.

5. The decorative sticker sheet of claim 4 wherein the heat treating is done at a temperature range from about 150 degree Celsius to about 180 degree Celsius.

6. The decorative sticker sheet of claim 4 wherein the transparent plastisol ink comprises polyvinyl choloride and plasticizer.

7. The decorative sticker sheet of claim 6 wherein the transparent plastisol ink further comprises binder and starch.

8. The decorative sticker sheet of claim 1 wherein the white plastisol layer is formed by silk screening white plastisol ink, and heat treating.

9. The decorative sticker sheet of claim 8 wherein the white plastisol ink comprises white pigments, polyvinyl choloride and plasticizer.

10. The decorative sticker sheet of claim 9 wherein the white plastisol ink further comprises binder and starch.

11. The decorative sticker sheet of claim 1 wherein the ink absorption layer is formed by coating surface active agent.

12. The decorative sticker sheet of claim 1 wherein the ink absorption layer further comprises white plastisol, binder and starch, and wherein the ink absorption layer is formed by applying mixture of white plastisol, binder, starch and surface active agent.

13. The decorative sticker sheet of claim 1 further comprising a print layer in which a design is printed on the ink absorption layer, and a protective coating layer formed on the print layer.

14. The decorative sticker sheet of claim 13 wherein the protective coating layer comprises a UV-resistant coating.

15. The decorative sticker sheet of claim 13 wherein the protective coating layer comprises a plastisol coating.

16. The decorative sticker sheet of claim 13 wherein the print layer comprises a photosensitive ink layer, and wherein the photosensitive ink layer is formed by applying photosensitive ink which is made from a mixture of transparent resin and photosensitive pigments.

17. The decorative sticker sheet of claim 13 wherein the print layer comprises a temperature-sensitive ink layer, and wherein the temperature-sensitive ink layer is formed by applying temperature-sensitive ink which is made from a mixture of transparent resin and temperature-sensitive pigments.

18. The decorative sticker sheet of claim 13 wherein the print layer comprises a fragrant agent layer.

19. The decorative sticker sheet of claim 13 further comprising a glassy particle layer wherein the glassy particle layer is formed on the protective coating layer, and the glassy particle layer is formed by applying a mixture of transparent resin and glass particles.

20. The decorative sticker sheet of claim 19 wherein the size of the glass particles is less than about 200 meshes.

21. A decorative sticker sheet comprising:

a) a lining paper;

b) an adhesive layer formed on the lining paper;

c) a transparent plastisol layer formed on the adhesive layer; and d) an ink absorption layer formed on the transparent plastisol layer;

wherein the transparent plastisol layer is formed by silk screening transparent plastisol ink and heat treating, wherein the ink absorption layer comprises white plastisol and surface active agent, and wherein the ink absorption layer is formed by silk screening a mixture of white plastisol ink and surface active agent, and heat treating.

22. The decorative sticker sheet of claim 21 further comprising a print layer in which a design is printed on the ink absorption layer, and a protective coating layer formed on the print layer.

23. The decorative sticker sheet of claim 22 wherein the protective coating layer comprises a UV-resistant coating.

24. The decorative sticker sheet of claim 22 wherein the protective coating layer comprises a plastisol coating.

25. The decorative sticker sheet of claim 22 further comprising a glassy particle layer wherein the glassy particle layer is formed on the protective coating layer, and the glassy particle layer is formed by applying a mixture of transparent resin and glass particles.

* * * * *